US006600268B2

(12) United States Patent
Horiuchi et al.

(10) Patent No.: US 6,600,268 B2
(45) Date of Patent: Jul. 29, 2003

(54) SHORT ARC MERCURY LAMP AND LAMP UNIT

(75) Inventors: Makoto Horiuchi, Nara (JP); Makoto Kai, Osaka (JP); Tsuyoshi Ichibakase, Osaka (JP); Tomoyuki Seki, Osaka (JP); Mamoru Takeda, Kyoto (JP); Shinichi Yamamoto, Osaka (JP); Kenichi Sasaki, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 67 days.

(21) Appl. No.: 09/865,964

(22) Filed: May 25, 2001

(65) Prior Publication Data

US 2002/0000777 A1 Jan. 3, 2002

(30) Foreign Application Priority Data

May 31, 2000 (JP) ..... 2000-162281

(51) Int. Cl.[7] ..... H01J 17/04

(52) U.S. Cl. ..... 313/631; 313/632; 313/633

(58) Field of Search ..... 313/635, 638, 313/332, 574, 623, 25, 633

(56) References Cited

FOREIGN PATENT DOCUMENTS

| | | |
|---|---|---|
| EP | 0 866 488 A1 | 9/1998 |
| JP | 06068849 A | 3/1994 |
| TW | 388908 | 5/2000 |

*Primary Examiner*—Nimeshkumar D. Patel
*Assistant Examiner*—Kenneth A Berck
(74) *Attorney, Agent, or Firm*—Harness, Dickey & Pierce, P.L.C.

(57) ABSTRACT

A short arc mercury lamp includes a luminous bulb enclosing at least mercury as a luminous material and a pair of electrodes opposed to each other; and a pair of sealing portions for sealing a pair of metal foils electrically connected to the pair of electrodes, respectively. The electrode central axis of one of the pair of electrodes is dislocated from the electrode central axis of the other electrode. The shortest distance d (cm) between the head of one of the electrodes and the head of the other electrode is larger than the value of $(6M/13.6\pi)^{1/3}$ when the total mass of the enclosed mercury is M (g).

7 Claims, 11 Drawing Sheets

SHORT ARC MERCURY LAMP AND LAMP UNIT

BACKGROUND OF THE INVENTION

The present invention relates to a short arc mercury lamp and a lamp unit. In particular, the present invention relates to a short arc mercury lamp and a lamp unit used as a light source for an image projection apparatus such as a liquid crystal projector and a digital micromirror device (DMD) projector.

In recent years, an image projection apparatus such as a liquid crystal projector or a projector using a DMD has been widely used as a system for realizing large-scale screen images, and a high-pressure discharge lamp having a high intensity has been commonly and widely used in such an image projection apparatus. In the image projection apparatus, light is required to be concentrated on a very small area of a liquid crystal panel or the like, so that in addition to high intensity, it is also necessary to achieve a light source close to a point light source.

As high pressure discharge lamps that can meet this need, the research and development of metal halide lamps was conducted first of all. However, it was found that when the arc length was reduced to achieve a light source close to a point light and high intensities, the arc width is increased in the case of metal halide lamps. Therefore, nowadays, a short arc ultra high pressure mercury lamp that is closer to a point light and has a high intensity has been noted widely as a promising light source. In the ultra high pressure mercury lamp, 90% of the entire luminous flux emit light in an effective region, whereas in the metal halide lamps having a large arc width, only 50% of the entire luminous flux emit light in an effective region. This occurs for the following reasons. In the case of the metal halide lamps, the average excitement potential of the enclosed metal is comparatively as low as 4 to 5 eV, and therefore emission occurs in the vicinity of the arc so that the arc width is large. On the other hand, in the case of the ultra high pressure mercury lamps, since mercury has a higher average excitement potential (7.8 ev) than that of the enclosed metal for the metal halide lamp, emission occurs in the central region of the arc, and thus the arc width is small. Therefore, the average intensity of the arc in the ultra high pressure mercury lamp can be higher than that of the metal halide lamp.

Referring to FIGS. 12A and 12B, a conventional short arc ultra high pressure mercury lamp 1000 will be described.

FIG. 12A is a schematic view of an ultra high pressure mercury lamp 1000. The lamp 1000 includes a substantially spherical luminous bulb 110 made of quartz glass, and a pair of sealing portions (seal portions) 120 and 120' also made of quartz glass and connected to the luminous bulb 110. A discharge space 115 is inside the luminous bulb 110. A mercury 118 in an amount of the enclosed mercury of, for example, 150 to 250 mg/cm$^3$ as a luminous material, a rare gas (e.g., argon with several tens kPa) and a small amount of halogen are enclosed in the discharge space 115.

A pair of tungsten electrodes (W electrode) 112 and 112' are opposed with a certain distance D (e.g., about 1.5 mm) in the discharge space 115. Each of the W electrodes 112 and 112' includes an electrode axis (W rod) 116 and a coil 114 wound around the head of the electrode axis 116. The coil 114 has a function to reduce the temperature at the head of the electrode. The respective electrode axes 116 of the W electrodes 112 and 112' are matched to be on the same axis to maintain the optical symmetry, and therefore, the electrode central axes 119 of the W electrodes 112 and 112' are matched to each other.

The electrode axis 116 of the W electrode 112 is welded to a molybdenum foil (Mo foil) 124 in the sealing portion 120, and the W electrode 112 and the Mo foil 124 are electrically connected by a welded portion 117 where the electrode axis 116 and the Mo foil 124 are welded. The sealing portion 120 includes a glass portion 122 extended from the luminous bulb 110 and the Mo foil 124. The glass portion 122 and the Mo foil 124 are attached tightly so that the airtightness in the discharge space 115 in the luminous bulb 110 is maintained. In other words, the sealing portion 120 is sealed by attaching the Mo foil 124 and the glass portion 122 tightly for foil-sealing. The sealing portions 120 have a circular cross section, and the rectangular Mo foil 124 is disposed in the center of the inside of the sealing portion 120. The Mo foil 124 of the sealing portion 120 includes an external lead (Mo rod) 130 made of molybdenum on the side opposite to the side on which the welded portion 117 is positioned. The Mo foil 124 and the external lead 130 are welded with each other so that the Mo foil 124 and the external lead 130 are electrically connected at a welded portion 132. The structures of the W electrode 112' and sealing portion 120' are the same as those of the W electrode 112 and sealing 120, so that description thereof will be omitted.

As shown in FIG. 12B, the lamp 1000 is electrically connected to a ballast 1200 for lighting. When the ballast 1200 is operated in the state where the external lead 130 is connected to the ballast 1200, the lamp 1000 turns on.

Next, the operational principle of the lamp 1000 will be described. When a start voltage is applied to the W electrodes 112 and 112' from the ballast 1200 via the external leads 130 and the Mo foils 124, discharge of argon (Ar) occurs. Then, this discharge raises the temperature in the discharge space 115 of the luminous bulb 110, and thus the mercury 118 is heated and evaporated. Thereafter, mercury atoms are excited and become luminous in the arc center between the W electrodes 112 and 112'. The higher the mercury vapor pressure of the lamp 1000 is, the higher the emission efficiency is, so that the higher mercury vapor pressure is suitable as a light source for an image projection apparatus. However, in view of the physical strength against pressure of the luminous bulb 110, the lamp 1000 is used at a mercury vapor pressure of 15 to 25 MPa.

The conventional lamp 1000 sometimes failed to turn on when the lamp was turned on again after turning off, although the lamp was used properly. The cause of the failure of lamp lighting was conventionally not clear. However, as a result of in-depth research, the inventors of the present invention found that this was caused by the fact that, as shown in FIG. 13, a bridge (mercury bridge) 140 of mercury 118 occurs between the W electrodes 112 and 112', so that the W electrodes 112 and 112' are short-circuited.

When a start voltage is applied to the lamp 1000 in a state where the electrodes are short-circuited by the mercury bridge 140, a large amount of current flows in the lamp 1000. As a result, the ballast 1200 detects operation abnormality and automatically stops the start of the lamp lighting. After the start of the lamp lighting is stopped, the mercury bridge 140 still remains, so that the lamp 1000 is not turned on, even if the ballast 1200 starts operating for lighting again.

It seems that the mercury bridge 140 is formed in the following manner. When turning on the lamp 1000, the temperature at the W electrodes 112 and 112' causing discharge is about 3000° C., and the temperature at the luminous bulb 110 positioned around the W electrodes is about 1000° C. When the lamp 1000 is turned off, the W electrode 112 made of a metal is cooled faster than the luminous bulb 110 made of glass. Therefore, mercury vapor in the discharge space 115 is condensed more on the W electrode 112 than on the inner wall of the luminous bulb 110, so that the mercury vapor is likely to precipitate as a mercury ball (Hg ball) in the W electrode 112.

When the W electrode 112 is cooled and the condensation of the mercury vapor proceeds, as shown in FIG. 14A, the Hg ball 118 is grown concentrically from the head 111 of the W electrode 112 towards the head of the opposing W electrode. Since the surface tension is applied to the Hg ball 118, the growth direction of the Hg balls 118 is the same direction as that of the electrode central axis 119. When the growth of the Hg ball 118*a* of the W electrode 112 proceeds and becomes in contact with the Hg ball 118*b* grown from the W electrode 112', the two Hg balls are integrated into one ball by the surface tension, so that as shown in FIG. 14B, the mercury bridge 140 is formed. Once the mercury bridge 140 is formed, the W electrodes 112 and 112' are short-circuited, and the start voltage cannot be applied normally to the lamp 1000, resulting in the failure of the operation of the lamp 1000.

Compared with a lamp having a comparatively long (e.g., about 1 cm) distance (electrode arrangement distance) D between the W electrodes 112 and 112', in the case of the lamp 1000 having a short arc with a distance D of about 2 mm or less, the amount of mercury to be enclosed in the discharge space 115 is increased to suppress the current increase involved in achieving short arc. Therefore, in the case of the short arc lamp, in addition to a short distance D, the amount of mercury condensed in the W electrode 112 becomes large, so that the mercury bridge 140 is formed more easily than in lamps having a comparatively long distance D. The distance D tends to be short to meet the need of achieving higher intensities and a light source close to a point light source, and therefore the problem of the mercury bridge will become more serious.

SUMMARY OF THE INVENTION

Therefore, with the foregoing in mind, it is a main object of the present invention to provide a short arc mercury lamp having improved reliability of lamp operation in which the mercury bridge is prevented or suppressed from being formed.

A short arc mercury lamp of the present invention includes a luminous bulb enclosing at least mercury as a luminous material and a pair of electrodes opposed to each other; and a pair of sealing portions for sealing a pair of metal foils electrically connected to the pair of electrodes, respectively; wherein an electrode central axis of one of the pair of electrodes is dislocated from an electrode central axis of the other electrode of the pair of electrodes, and a shortest distance d (cm) between a head of one of the electrodes and a head of the other electrode is larger than a value of $(6M/13.6\pi)^{1/3}$ when a total mass of the enclosed mercury is M (g).

Another short arc mercury lamp of the present invention includes a luminous bulb enclosing at least mercury as a luminous material and a pair of electrodes opposed to each other; and a pair of sealing portions for sealing a pair of metal foils electrically connected to the pair of electrodes, respectively, wherein an electrode central axis of one of the pair of electrodes and an electrode central axis of the other electrode are not on the same common axis, and a projection plane where a head plane of one of the electrodes is projected along a direction of the electrode central axis of the one of the electrodes is in contact with or at least partially overlapped with a head plane of the other electrode.

Still another short arc mercury lamp of the present invention includes a luminous bulb enclosing at least mercury as a luminous material and a pair of electrodes opposed to each other; and a pair of sealing portions for sealing a pair of metal foils electrically connected to the pair of electrodes, respectively; wherein a shortest distance d between the head of one of the electrodes and the head of the other electrode is longer than an arrangement distance D between one of the electrodes and the other electrode.

It is preferable that the shortest distance d (cm) between the head of one of the electrodes and the head of the other electrode is larger than a value of $(6M/13.6\pi)^{1/3}$ when a total mass of the enclosed mercury is M (g).

In one embodiment of the present invention, lighting system is an alternating current lighting system.

A lamp unit of the present invention includes the above-described short arc mercury lamp and a reflecting mirror for reflecting light emitted from the mercury lamp.

A high pressure mercury lamp of the present invention includes a luminous bulb enclosing at least mercury as a luminous material and a pair of electrodes opposed to each other; and a pair of sealing portions for sealing a pair of metal foils electrically connected to the pair of electrodes, respectively; wherein an electrode central axis of one of the pair of electrodes is dislocated from an electrode central axis of the other electrode, and a shortest distance d (cm) between a head of one of the electrodes and a head of the Hi other electrode is larger than a value of $(6M/13.6\pi)^{1/3}$ when a total mass of the enclosed mercury is M (g).

It is preferable that the arc length of the high pressure mercury lamp is 2 mm or less, and a total mass of the enclosed mercury is 150 mg/cm$^3$ or more.

According to the short arc mercury lamp of the present invention, the electrode central axis of one electrode is dislocated from the electrode central axis of the other electrode. Therefore, even if mercury enclosed in a luminous bulb is condensed and is grown from the head of one electrode, the mercury does not become in contact with the mercury grown from the other electrode along the electrode central axis of the other electrode, compared with the prior art. As a result, the mercury bridge can be prevented or suppressed from being formed between the pair of electrodes. Furthermore, the electrode central axes are not matched with each other, so that even if the mercury bridge is formed, the surface tension is not applied to the formed mercury bridge symmetrically. Therefore, the mercury bridge cannot stay stably between the heads of the electrodes, and even if the mercury bridge is formed, the mercury bridge can be removed easily. Thus, the reliability of the lamp operation can be improved.

Furthermore, according to another short arc mercury lamp of the present invention, in addition to the prevention or suppression of the mercury bridge by the fact that the respective electrode central axes of the pair of electrodes are not on the same and common axis, the following advantage is provided. Since the projection plane of one electrode is in contact with the head plane of the other electrode, or at least a part is overlapped, this embodiment is substantially not different from the case where the axes of the electrodes are on the same axis, at least regarding the stability of discharge.

Furthermore, according to still another short arc mercury lamp of the present invention, the shortest distance d between the head of one electrode and the head of the other electrode is longer than the arrangement distance D between one electrode and the other electrode. Therefore, the mercury grown from the heads of the two electrodes are not in contact with each other, compared with the prior art, even if the arrangement distance D is the same as that of the prior art. As a result, the formation of the mercury bridge can be prevented or suppressed. Thus, the reliability of the lamp operation can be improved. Furthermore, since the arrangement distance D is the same, in the structure where the mercury lamp and a reflecting mirror are combined, the same light focusing efficiency as that of the conventional structure can be obtained.

According to the mercury lamp of the present invention, the formation of the mercury bridge can be prevented or suppressed, and therefore the reliability of the lamp operation can be improved. Furthermore, as a result of preventing or suppressing the formation of the mercury bridge, it is possible to increase the amount of enclosed mercury, so that the performance of the mercury lamp can be improved.

This and other advantages of the present invention will become apparent to those skilled in the art upon reading and understanding the following detailed description with reference to the accompanying figures.

DETAILED DESCRIPTION OF THE INVENTION

Figure 1:
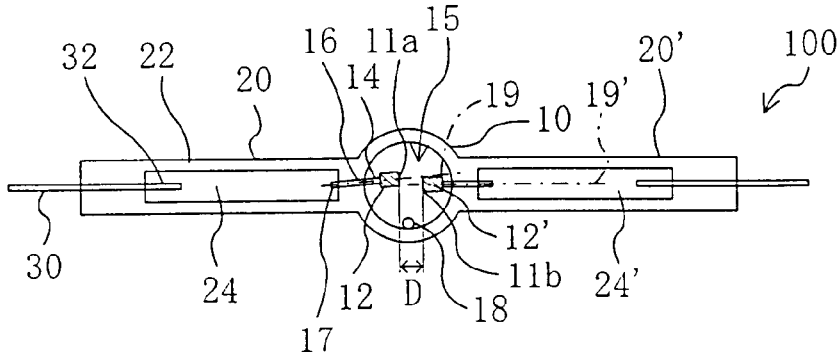
FIG. 1 is a schematic view showing the structure of a mercury lamp 100 of Embodiment 1.

Hereinafter, embodiments of the present invention will be described with reference to the accompanying drawings. In the following drawings, for simplification, the elements having substantially the same functions bear the same reference numeral.

First, FIG. 1 is referred to. FIG. 1 schematically shows the structure of a mercury lamp 100 of an embodiment of the present invention.

The mercury lamp 100 of Embodiment 1 includes a luminous bulb 10, and a pair of sealing portions 20 and 20' connected to the luminous bulb 10. A discharge space 15 in which a luminous material 18 is enclosed is provided inside the luminous bulb 10. A pair of electrodes 12 and 12' are opposed to each other in the discharge space 15. The luminous bulb 10 is made of quartz glass and is substantially spherical. The outer diameter of the luminous bulb 10 is, for example, about 5 mm to 20 mm. The glass thickness of the luminous bulb 10 is, for example, about 1 mm to 5 mm. The volume of the discharge space 15 in the luminous bulb 10 is, for example, about 0.01 to 1.0 cc. In this embodiment, the luminous bulb 10 having an outer diameter of about 13 mm, a glass thickness of about 3 mm, a volume of the discharge space 15 of about 0.3 cc is used. As the luminous material 18, mercury is used. For example, about 150 to 200 mg/cm$^3$ of mercury, a rare gas (e.g., argon) with 5 to 20 kPa, and a small amount of halogen are enclosed in the discharge space 15. In FIG. 1, mercury 18 attached to the inner wall of the luminous bulb 10 is schematically shown.

The pair of electrodes 12 and 12' in the discharge space 15 are arranged with an electrode arrangement distance D of, for example, about 2 mm or less so as to constitute a short arc type. As the electrodes 12 and 12', for example, tungsten electrodes (W electrodes) are used. In this embodiment, the W electrodes 12 and 12' are arranged with a distance D of about 1.5 mm. A coil 14 is wound around the head of each of the electrodes 12 and 12'. The coil 14 has a function to lower the temperature of the electrode head. An electrode axis (W rod) 16 of the electrode 12 is electrically connected to the metal foil 24 in the sealing portion 20. Similarly, an electrode axis 16 of the electrode 12' is electrically connected to the metal foil 24' in the sealing portion 20'.

The sealing portion 20 includes a metal foil 24 electrically connected to the electrode 12 and a glass portion 22 extended from the luminous bulb 10. The airtightness in the discharge space 15 in the luminous bulb 10 is maintained by the foil-sealing between the metal foil 24 and the glass portion 22. The metal foil 24 is a molybdenum foil (Mo foil), for example, and has a rectangular shape, for example. The glass portion 22 is made of quartz glass, for example. The metal foil 24 in the sealing portion 20 is joined with the electrode 12 by welding. The metal foil 24 includes an external lead 30 on the side opposite to the side where the electrode 12 is joined. The external lead 30 is made of, for example, molybdenum. This design of the sealing portion 20 applies to the sealing portion 20', so that further description is omitted.

In the lamp 100 of this embodiment, the electrode central axis 19 of the electrode 12 is dislocated from the electrode central axis 19' of the electrode 12' to prevent or suppress from a mercury bridge from being formed. In other words, the electrode central axis 19 of the electrode 12 and the electrode central axis 19' of the electrode 12' are not on the same axis. When the electrode central axis 19 of the electrode 12 and the electrode central axis 19' of the electrode 12' are not on the same axis, the following advantage is provided. As shown in an enlarged view of FIG. 2, even if a mercury balls 18*a* and 18*b* are grown from the head 11*a* of the electrode 12 and the head 11*b* of the electrode 12', respectively, along the electrode central axes 19 and 19', the mercury balls 18*a* and 18*b* are hardly in contact with each other, compared with the case where the electrode central axes 19 and 19' are on the same axes. In other words, since the pair of electrodes 12 and 12' are not on the same axes, the shortest distance d between the head 11*a* of the electrode 12 and the head 11*b* of the electrode 12', can be made longer than the electrode arrangement distance D between the electrodes 12 and 12'. Thus, formation of a mercury bridge can be prevented or suppressed.

In the prior art, the pair of electrodes is arranged on the same axis, and therefore the electrode arrangement distance D is equal to the distance d between the electrode heads. On the other hand, the lamp 100 of this embodiment, only the distance d between the electrode heads can be increased while the electrode arrangement distance D is unchanged. Therefore, this embodiment makes it difficult for the mercury balls 18*a* and 18*b* growing from the respective heads 11*a* and 11*b* to be in contact with each other without increasing the size of the luminous bulb 10 or the entire lamp 100 to increase the electrode arrangement distance D. The electrode arrangement distance D is determined by, for example, the size of the luminous bulb 10 or the size of the entire lamp 100, and the electrode arrangement distance D in this embodiment refers to the length between the heads of the pair of electrodes in the direction component of the electrode central axis 19'.

Figure 3:
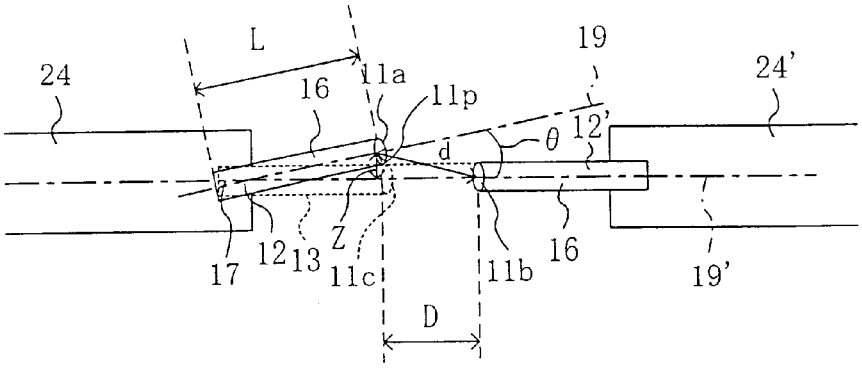
FIG. 3 is a schematic enlarged view showing the structure of a pair of electrodes 12 and 12'.

For more detailed description of the structure of the pair of electrodes 12 and 12' of the lamp 100 in this embodiment, FIG. 3 shows an enlarged view of the vicinity of the pair of electrodes 12 and 12'. In FIG. 3, for simplification, the coils 14 wound around the heads of the electrodes 12 and 12' are omitted.

As shown in FIG. 3, one electrode 12 of the pair of electrodes is dislocated from a virtual position 13 where the electrode central axes of the two electrodes agree with each other to a position where the angle formed by the electrode central axes 19 and 19' is θ with the joint (welded portion) 17 between the electrode 12 and the metal foil 24 as the center. In the lamp 100 of this embodiment, the other electrode 12' of the pair of electrodes is not moved, so that the electrode central axis 19' agrees with the virtual electrode central axis on which the electrode central axes of the two electrodes agree with each other.

In this embodiment, for the electrodes 12 and 12', electrode rods 16 having a length L of 10 mm and an outer diameter Φ of 1.4 mm are used. The electrode central axis 19 of the electrode 12 is dislocated to a potion 11*p*, where the outer edge of a projection plane 11*c* on which the head 11*b* of the electrode 12' is projected to the direction of the electrode central axis 19' is in contact with the outer edge of the head 11*a* of the electrode 12. In this case, the dislocation amount Z from the electrode central axis 19' (that is, the distance between the electrode head 11*a* positioned on the electrode central axis 19 and the electrode central axis 19') is substantially equal to the outer diameter Φ of the electrode rod 16, and therefore the dislocation amount Z is about 1.4 mm. Therefore, the angle θ formed by the electrodes axes 19 and 19' when the electrode central axis 19 of the electrode 12 is dislocated to the position 11*p* where the outer edge of the projection plane 11*c* is in contact with the outer edge of the head 11*a* of the electrode 12 can be calculated by the following equation (I).

$$\tan\theta = \text{Dislocation amount } Z \text{ electrode rod length } L = 1.4\ mm\ 10\ mm \qquad \text{Equation (I)}$$

Figure 12A:
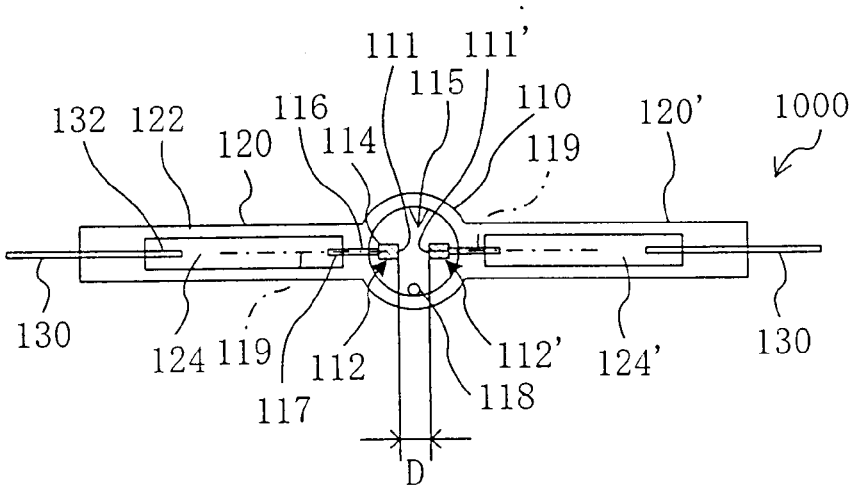
FIG. 12A is a schematic view showing the structure of a conventional mercury lamp 1000.
Figure 12B:
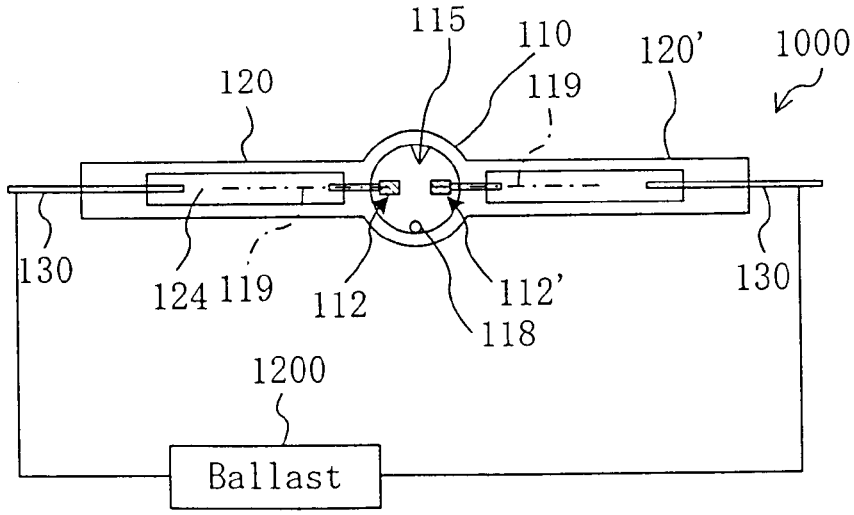
FIG. 12B is a schematic view showing the structure of the mercury lamp 1000 connected to a ballast 1200.
Figure 13:
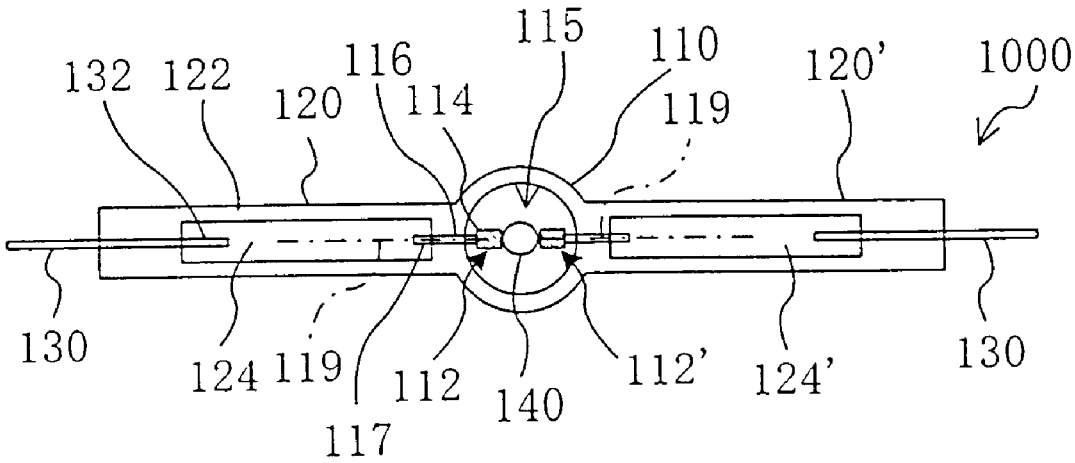
FIG. 13 is a view for explaining the problems of the conventional mercury lamp 1000.
Figure 14A:
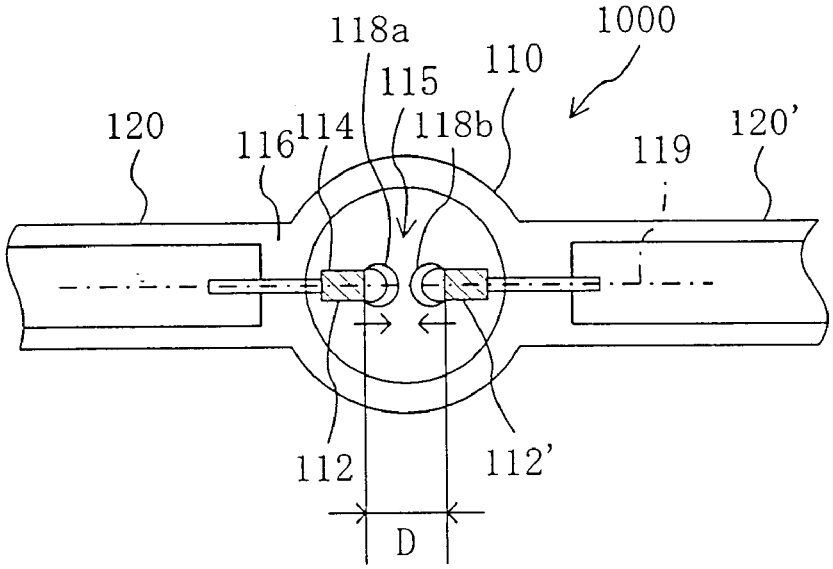
FIGS. 14A and 14B are views for explaining the problems of the conventional mercury lamp 1000.
Figure 14B:
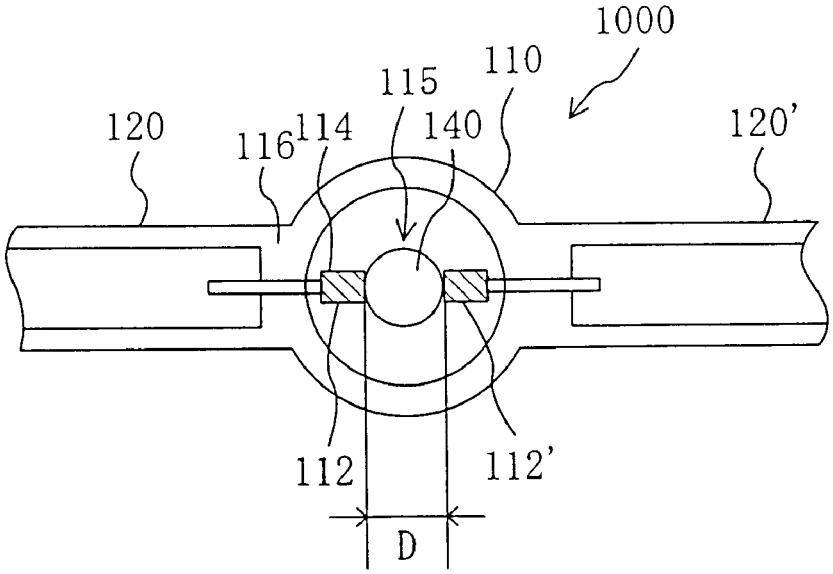

In this case, the angle θ is about 8 degrees. The dislocation amount Z is a value of more than zero, and is, for example, 10% or more of the electrode arrangement distance D (or arc length) (when the electrode arrangement distance D is 1.5 mm, the dislocation amount Z is 0.15 mm or more). Specific dislocation amounts Z can be determined suitably depending on the characteristics of the lamp 100. The discharge between the pair of electrodes 12 and 12' in the lamp 100 occurs in the entire head planes 11*a* and 11*b* of the electrodes. Therefore, as in this embodiment, by at least bringing the outer edge of the projection plane 11*c* of the electrode 12' in contact with the head plane 11*a* of the electrode 12, that is, by preventing the outer edge of the projection plane 11*c* from being apart from the outer edge of the head plane 11*a*, the same level of discharge stability as when the electrodes are on the same axis can be obtained, and formation of a mercury bridge can be prevented or suppressed with little influence on the discharge characteristics. In the conventional lamp 1000 shown in FIG. 12, the electrode central axes 119 of the pair of electrodes 112 and 112' are on the same axis, and therefore the electrode central axes 119 of the pair of electrodes 112 and 112' agree with each other. Even when the electrode central axes 119 of the pair of electrodes 112 and 112' are not completely matched in the physical sense, it is ensured that the electrode central axes 119 are on the same axis with a dislocation within the range of less than 10% of the electrode arrangement distance.

The mercury ball 18*a* formed concentrically in the head 11*a* of the electrode 12 is spherical (the mercury ball has a radius r), and as known from the volume of the mercury ball 18*a* is $(4/3)\pi r^3$, a cube of the radius r of the mercury ball is in proportion to the volume. Therefore, even a small increase in the distance d between the electrode heads makes it possible to prevent or suppress effectively the formation of the mercury bridge. Furthermore, mercury 18 in a larger amount can be enclosed in the luminous bulb 10 while preventing or suppressing the mercury bridge, so that the emission efficiency can be improved.

In the case of the lamp 100 of this embodiment, the electrode arrangement distance D is 1.5 mm, and the dislocation amount Z is 1.4 mm (which is equal to the outer diameter Φ of the electrode rod), and therefore the distance d between the electrode heads is 2.05 mm from Equation (II).

$$d=(D^2+\Phi^2)^{1/2}=(1.5^2+1.4^2)^{1/2}=2.05 \qquad \text{Equation (II)}$$

Figure 2:
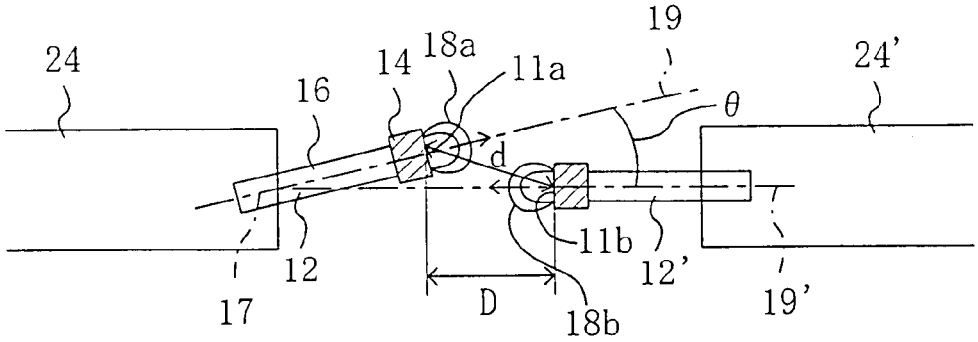
FIG. 2 is an enlarged view of a pair of electrodes 12 and 12' in a state where a mercury ball 18 is grown.
Figure 4:
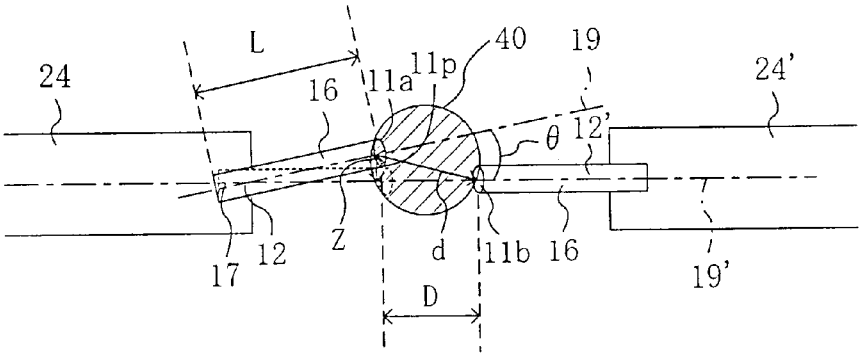
FIG. 4 is an enlarged view of a pair of electrodes 12 and 12' in a state where a mercury bridge 40 is formed.
Figure 5:
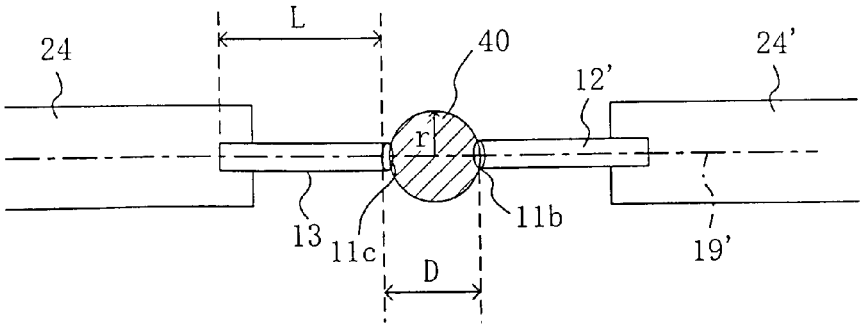
FIG. 5 is an enlarged view of a pair of electrodes 12 and 12' in a state where a mercury bridge 40 is formed.

FIGS. 4 and 5 schematically show the state where a mercury bridge 40 is formed in the lamp 100 having the structure shown in FIG. 2 (angle θ=about 8°) and the state where a mercury bridge 40 is formed in the lamp having the structure where the angle θ of FIG. 4 is zero, respectively. Since the cube of the radius r of the mercury ball is in proportion to the volume, the ratio of the volume ($V_1$) of the mercury ball 40 shown in FIG. 4 to the volume ($V_0$) of the mercury ball 40 shown in FIG. 5 is 2.55:1 from Equation (III).

$$V_1 : V_0 = (d/2)^3 : (D/2)^3 \qquad \text{Equation (III)}$$

$$d^3 : D^3 = 8.62 : 3.38 = 2.55 : 1$$

In other words, it is understood that the structure shown in FIG. 4 can contain mercury in an amount of 2.55 times larger than that of the structure shown in FIG. 5. Furthermore, even if the mercury bridge is formed, in the structure of FIG. 5, the surface tension is applied symmetrically to the mercury bridge 40, so that the mercury bridge 40 is likely to be maintained between the pair of electrodes. On the other hand, in the structure of FIG. 4, the surface tension is not applied symmetrically, so that the mercury bridge 40 can fall down easily without being maintained between the pair of electrodes. Thus, the formation of the mercury bridge 40 is also prevented by the difference in the manner in which the surface tension is applied.

It is also possible to suppress the formation of the mercury bridge simply by increasing the electrode arrangement distance D in the conventional mercury lamp. However, in this case, when the mercury lamp is combined with a reflecting mirror, the light focusing efficiency (utilization ratio of light emitted from the mirror) is significantly dropped. On the other hand, the structure of the mercury lamp of this embodiment, the formation of the mercury bridge can be suppressed effectively without dropping the light focusing efficiency, as described above.

An approximate distance d between the electrode heads can be calculated from the amount (g) of the mercury 18 to be enclosed in the luminous bulb 10, and the mercury bridge formed between the electrode heads is spherical (radius r), and therefore it is sufficient that the distance d between the electrode heads is longer than 2 r. More specifically, when the total mass of the mercury 18 enclosed in the luminous bulb 10 is M (g), the relationship $(4/3)\pi r^3 \times 13.6\ [g/cm^3]=M$ is satisfied. Therefore, the 2 r[cm] of the mercury bridge is $(6M/13.6\pi)^{1/3}$. Therefore, when the distance d between the electrode heads is larger than a value of $(6M/13.6\pi)^{1/3}$, the formation of the mercury bridge 40 can be prevented and suppressed effectively.

Figure 6A:
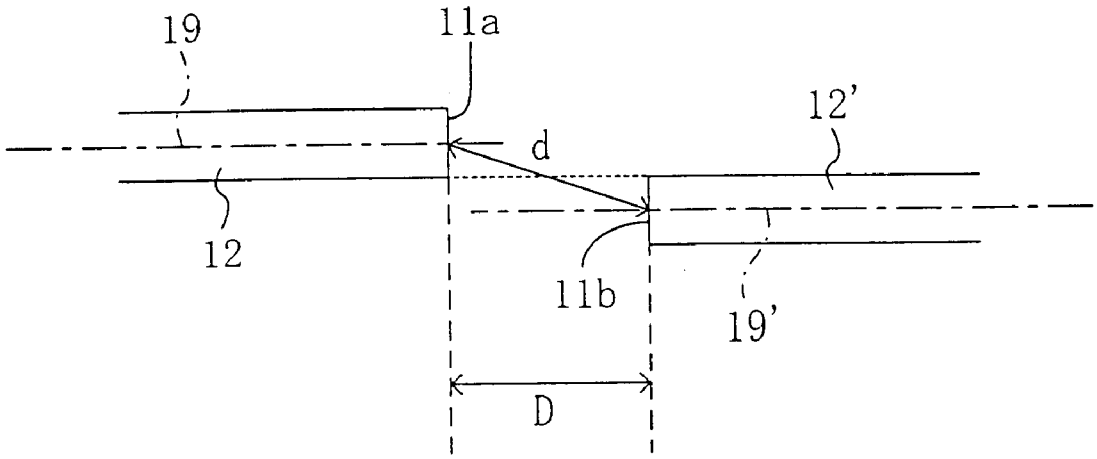
FIG. 6A is a schematic view showing the structure of a pair of electrodes 12 and 12'.
Figure 6B:
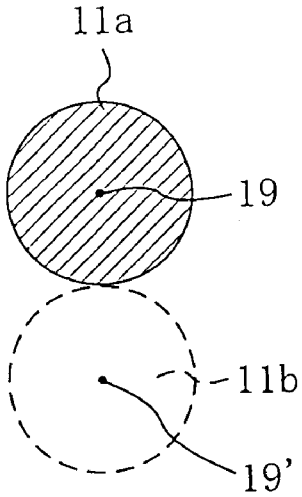
FIG. 6B is a schematic cross-sectional view showing electrode heads 11*a* and 11*b* viewed along the electrode central axis 19'.

As shown in FIGS. 6A and 6B, the pair of electrodes 12 and 12' can be dislocated but disposed in parallel to each other so that the electrode central axes 19 and 19' are not on the same axis. FIG. 6A schematically shows an arrangement of the pair of electrodes 12 and 12', and FIG. 6B schematically shows the cross sections of the electrode heads 11*a* and 11*b* viewed from the electrode central axis 19'. This structure also makes it possible to make the distance d between the electrode heads longer than the electrode arrangement distance D, and thus the formation of the mercury bridge can be prevented or suppressed. In this example, the dislocation amount Z is equal to the outer diameter Φ of the electrode 12, and the outer edge of the projection plane on which the head plane 11*b* of the electrode 12' is projected along the direction of the electrode central axis 19' is in contact with the outer edge of the head plane 11*a* of the electrode 12.

Figure 7A:
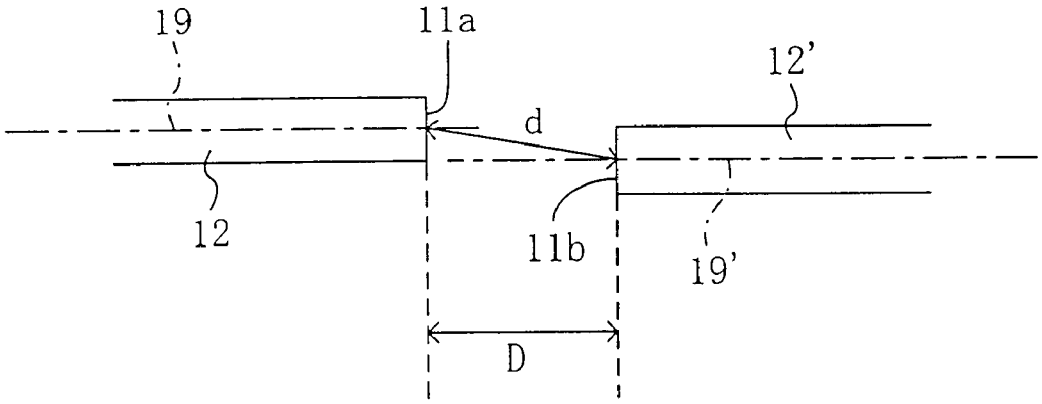
FIG. 7A is a schematic view showing the structure of a pair of electrodes 12 and 12'.
Figure 7B:
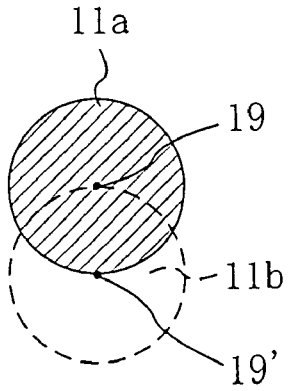
FIG. 7B is a schematic cross-sectional view showing electrode heads 11*a* and 11*b* viewed along the electrode central axis 19'.
Figure 8:
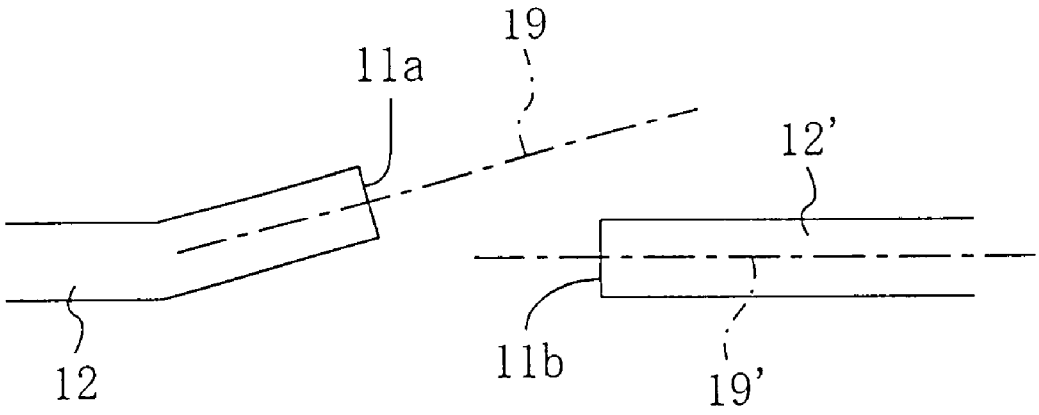
FIG. 8 is a view showing the structure of a variation of this embodiment.

As shown in FIGS. 7A and 7B, the dislocation amount Z can be, for example, a half of the outer diameter Φ of the electrode 12, and the projection plane on which the head plane 11*b* of the electrode 12' is projected can be at least partially overlapped with the outer edge of the head plane 11*a* of the electrode 12. Furthermore, as shown in FIG. 8, it is possible to bend the head portion of the electrode 12 to make the distance d between the electrode heads longer than the electrode arrangement distance D. In the case of the structure shown in FIG. 8, the electrode central axes 19 and 19' are not on the same axis, based on the electrode central axis 19 in the head of the electrode 12.

In the above embodiments, only the electrode central axis 19 of one electrode 12 of the pair is dislocated. However, it is possible that the electrode central axis 19' of the electrode 12' also can be dislocated together with the electrode central axis 19 of the electrode 12. In this case, when moving both the electrode central axes makes it difficult to set a virtual common axis, the dislocation can be based on the longitudinal direction of the lamp, instead of the virtual common axis. In the above embodiments, the electrode rods 16 having the same length L and the same outer diameter Φ are used for the pair of electrodes 12 and 12'. However, the present invention is not limited thereto, and those having different lengths or different outer diameters can be used. Furthermore, the pair of electrodes can be different from each other in the number of windings of the coil 14 or the diameter of the coil 14.

Next, an example of a method for producing the mercury lamp 100 will be described. First, the metal foil (Mo foil) 24 having the electrode 12 and the external lead 30 is inserted in a glass pipe for a discharge lamp having a portion for the luminous bulb 10 and a portion for the glass portion 22. Then, the pressure in the glass pipe is reduced (e.g., less than one atmospheric pressure), and the glass tube is heated and softened, for example with a burner, so that the glass tube 22 and the metal foil 24 are attached and the sealing portion 20 is formed. The other sealing portion 20' is formed in the same manner and thus the mercury lamp is produced. In the process of forming the sealing portions, the sealing portion 20 is formed such that the electrode central axis 19 of one electrode 12 is dislocated from the virtual common axis 19' (electrode central axis 19'), so that the lamp 100 having the pair of electrodes 12 and 12' that are not on the same axis can be produced.

Figure 9:
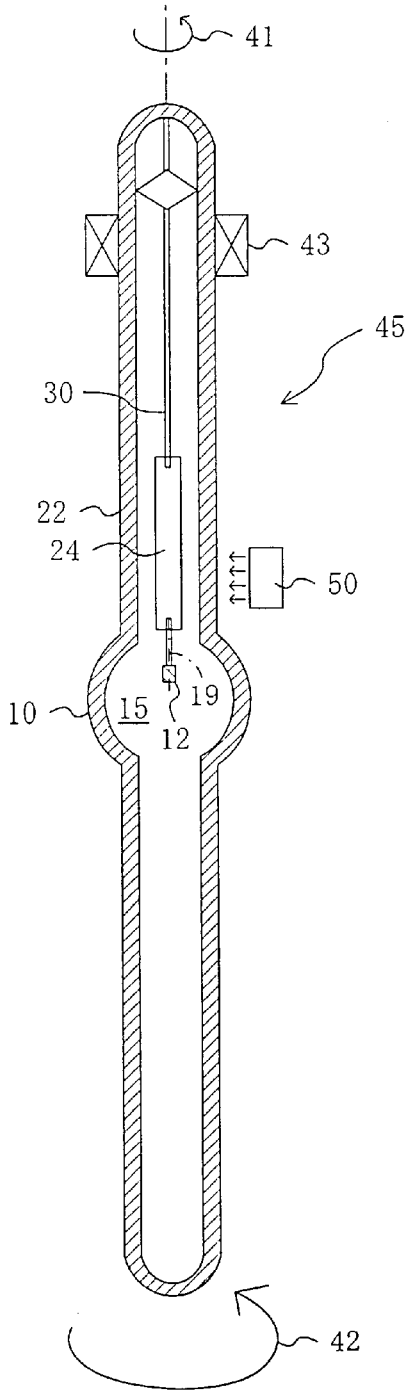
FIG. 9 is a cross-sectional view showing processes for illustrating a method for producing the mercury lamp 100 in this embodiment.

Hereinafter, the method will be described by way of a specific example with reference to FIG. 9. FIG. 9 is a cross sectional view showing a production process of the mercury lamp 100.

First, a glass pipe 45 for a discharge lamp having a portion for the luminous bulb 10 and a portion for the glass portion 22 is disposed in the vertical direction. Then, the glass pipe 45 is supported with a chuck 43 such that the pipe can rotate in the direction shown by arrows 41 and 42. Next, the metal foil 24 (electrode assembly) having the electrode 12 and the external lead 30 is inserted in the glass pipe 45, and then the glass pipe 45 is sealed airtightly for pressure reduction. In FIG. 9, both ends of the glass pipe 45 are sealed for airtight sealing of the glass pipe 45. However, the present invention is not limited to this structure, and any structures can be used as long as the pressure in the glass pipe 45 can be reduced.

Next, when the pressure in the glass pipe 45 is reduced (e.g., 20 kPa), and the glass pipe is rotated in the direction shown by the arrows 41 and 42, and then a part of the glass tube 22 is heated and softened with, for example, a burner 50. At this time, only the upper portion of the glass pipe 45 is supported with the chuck 43 without supporting the lower portion of the glass pipe 45 with a chuck 43 so that the lower end of the glass pipe is free. When the glass pipe 45 is rotated in this state, the lower end of the glass pipe 45 orbits because of inertia. In such a state, when the glass tube 22 and the metal foil 24 are attached tightly, the sealing portion 20 having a structure where the electrode central axis 19 of the electrode 12 is dislocated from the virtual common axis 19' by a predetermined angle θ can be formed. When it is desired to cause more forceful orbiting rotation of the lower end of the glass pipe 45, for example, a conical member 46 is provided in a lower portion of the glass pipe 45, and the glass pipe 45 is rotated along the side face of the conical member 46.

Instead of the method of causing the orbiting rotation in the lower end of the glass pipe 45, the pair of electrodes 12 and 12' that are not on the same axis can be formed by dislocating one metal foil 24 (electrode assembly) from the other metal foil 24' (electrode assembly) by a predetermined amount at the time of insertion into the glass pipe 45 and sealing. Furthermore, only a part of the glass tube (glass portion) 22 is heated with the burner 50 while controlling the rotation speed of the glass pipe 45, so that the electrode central axis 19 of the electrode 12 can be dislocated from the virtual same axis 19'. In other words, the glass tube 22 is not uniformly heated, and a predetermined portion of the glass portion is melted by local heating to dislocate the metal 24 (electrode assembly) from the central position, so that the electrode central axis 19 of the electrode 12 can be dislocated.

Figure 10:
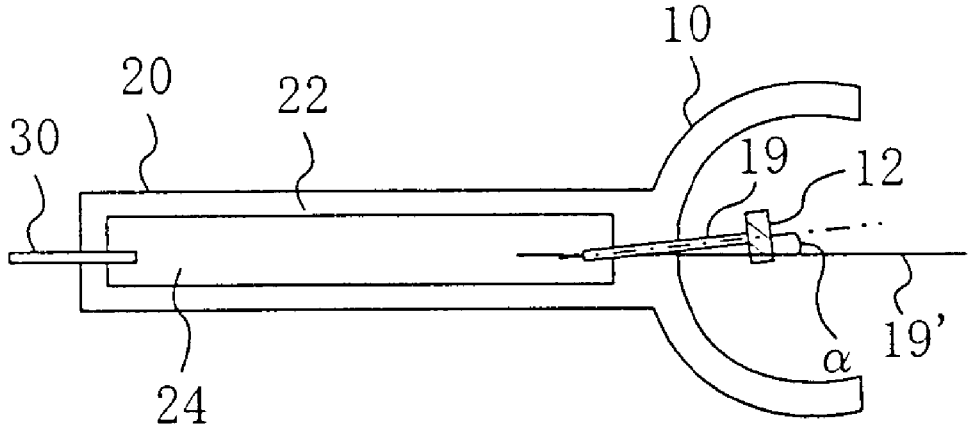
FIG. 10 is a view showing the structure of a variation of this embodiment.

Furthermore, as shown in FIG. 10, the electrode 12 is connected to the metal foil 24 with a tilt of a predetermined angle $\alpha$ with respect to, for example, the other electrode central axis 19' (or the virtual common axis 19'), and the electrode 12 and the metal foil 24 are sealed in the glass portion 22, so that the lamp where the pair of electrodes are not on the same axis can be produced. Instead of the tilted electrode 12, electrodes that are dislocated in parallel or those having a bent head portion also can be sealed therein to obtain the structure where the pair of electrodes 12 and 12' are not on the same axis.

Embodiment 2

Figure 11:
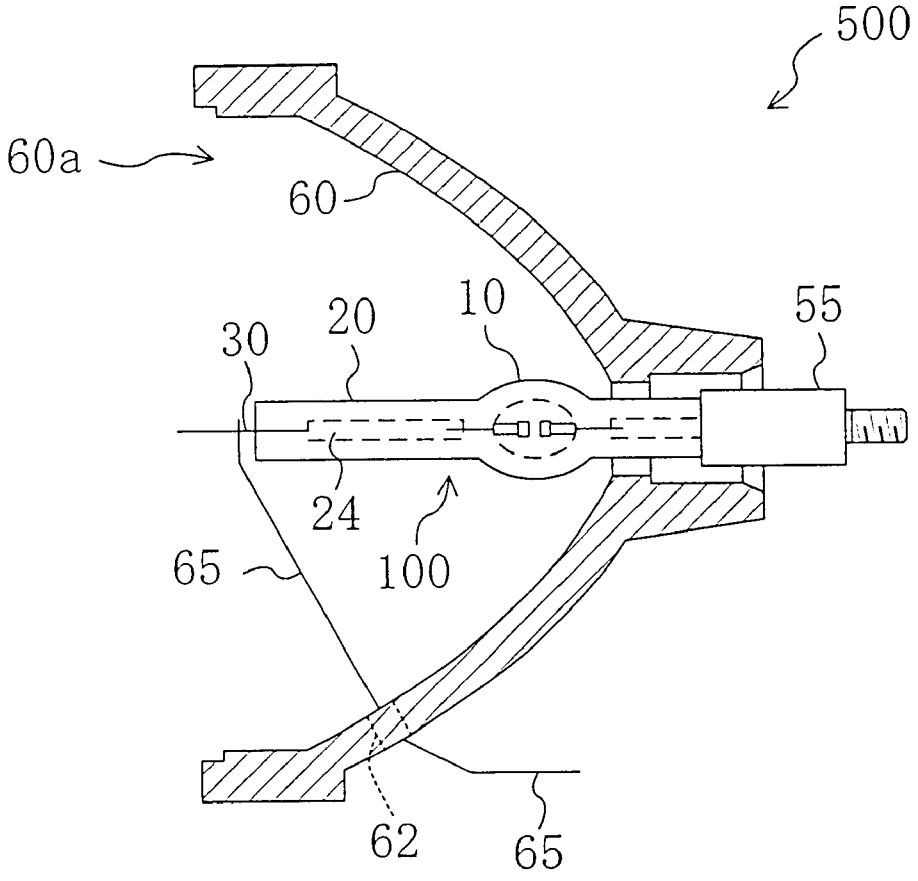
FIG. 11 is a schematic cross-sectional view showing the structure of a lamp unit 500 of Embodiment 2.

The mercury lamp of Embodiment 1 can be formed into a lamp unit in combination with a reflecting mirror. FIG. 11 is a schematic cross-sectional view of a lamp unit 500 including the mercury lamp 100 of Embodiment 1.

The lamp unit 500 includes the mercury lamp 100 including a substantially spherical luminous portion 10 and a pair of sealing portions 20 and a reflecting mirror 60 for reflecting light emitted from the mercury lamp 100. The mercury lamp 100 is only illustrative, and any one of the mercury lamps of the above embodiments can be used.

The reflecting mirror 60 is designed to reflect the radiated light from the mercury lamp 100 such that the light becomes, for example, a parallel luminous flux, a focused luminous flux converged on a predetermined small area, or a divergent luminous flux equal to that emitted from a predetermined small area. As the reflecting mirror 60, a parabolic reflector or an ellipsoidal mirror can be used, for example.

In this embodiment, a lamp base 55 is attached to one of the sealing portion 20 of the mercury lamp 100, and the external lead 30 extending from the sealing portion 20 and the lamp base 55 are electrically connected. The sealing portion 20 attached with the lamp base 55 is adhered to the reflecting mirror 60, for example, with an inorganic adhesive (e.g., cement) so that they are integrated. A lead wire 65 is electrically connected to the external lead 30 of the sealing portion 20 positioned on the front opening 60*a* side of the reflecting mirror 60. The lead wire 65 extends from the external lead 30 to the outside of the reflecting mirror 60 through an opening 62 for a lead wire of the reflecting mirror 60. For example, a front glass can be attached to the front opening 60*a* of the reflecting mirror 60.

Such a lamp unit can be attached to an image projection apparatus such as a projector employing liquid crystal or DMD, and is used as the light source for the image projection apparatus. The mercury lamp and the lamp unit of the above embodiments can be used, not only as the light source for image projection apparatuses, but also as a light source for ultraviolet steppers, or a light source for an athletic meeting stadium, a light source for headlights of automobiles or the like. Moreover, the lamp unit can be used as a floodlight for illuminating traffic signs.

In the mercury lamp of the above embodiments, the alternating current lighting system is used as the lighting system. However, either the alternating current lighting or the direct current lighting can be used. Furthermore, in the above embodiments, the short arc mercury lamp has been described, but the present invention is not limited to the short arc type, and preferably can apply to a mercury lamp having a large amount of enclosed mercury, even if the mercury lamp has a comparatively long arc length. In the case of a high pressure mercury lamp with high output and high power, mercury is enclosed in a larger amount than usual to suppress acceleration of evaporation of electrode with increasing current. In recent years, high pressure mercury lamps with higher output and higher power are under development, and therefore the problem of the mercury bridge may be caused in not only short arc mercury lamps but also in other lamps. In the above embodiments, the mercury lamps having an amount of enclosed mercury of 150 to 250 mg/cm$^3$ has been described, but the amount of enclosed mercury may be 250 mg/cm$^3$ or more.

Furthermore, in the above embodiments, the case where the mercury vapor pressure is about 20 MPa (the case of so-called ultra high pressure mercury lamp) has been described. However, the present invention can apply to a high pressure mercury lamp where the mercury vapor pressure is about 1 MPa. In this specification, a mercury lamp where the mercury vapor pressure is about 1 MPa or more is referred to as a high pressure mercury lamp, and the high pressure mercury lamp includes an ultra high pressure mercury lamp. Since the higher the mercury vapor pressure is, the more preferable the emission spectrum is as the light source for image projection apparatus. Therefore, in the case where the physical strength against pressure of the luminous tube can be ensured, the mercury vapor pressure can be about 20 MPa or more.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A short arc mercury lamp comprising:

a luminous bulb enclosing at least mercury as a luminous material and a pair of electrodes opposed to each other; and a pair of sealing portions for sealing a pair of metal foils electrically connected to the pair of electrodes, respectively;

wherein an electrode central axis of one of the pair of electrodes is dislocated from an electrode central axis of the other electrode, and a shortest distance d (cm) between a head of one of the electrodes and a head of the other electrode is larger than a value of $(6M/13.6\pi)^{1/3}$ when a total mass of the enclosed mercury is M (g).

2. A short arc mercury lamp comprising:

a luminous bulb enclosing at least mercury as a luminous material and a pair of electrodes opposed to each other; and a pair of sealing portions for sealing a pair of metal foils electrically connected to the pair of electrodes, respectively;

wherein an electrode central axis of one of the pair of electrodes and an electrode central axis of the other electrode are not on the same common axis, and a projection plane where a head plane of one of the electrodes is projected along a direction of the electrode central axis of the one of the electrodes is in contact with or at least partially overlapped with a head plane of the other electrode, wherein the shortest distance d (cm) between a head of one of the electrodes and a head of the other electrode is larger than a value of $(6M/13.6\pi)^{1/3}$ when a total mass of the enclosed mercury is M (g).

3. A short arc mercury lamp comprising:

a luminous bulb enclosing at least mercury as a luminous material and a pair of electrodes opposed to each other; and a pair of sealing portions for sealing a pair of metal foils electrically connected to the pair of electrodes, respectively;

wherein a shortest distance d between a head of one of the electrodes and a head of the other electrode is longer than an arrangement distance D between one of the electrodes and the other electrode, wherein the shortest distance d (cm) between a head of one of the electrodes and a head of the other electrode is larger than a value of $(6M/13.6\pi)^{1/3}$ when a total mass of the enclosed mercury is M (g).

4. The short arc mercury lamp of claim 1, wherein lighting system is an alternating current lighting system.

5. A lamp unit comprising the short arc mercury lamp of claim 1, 2 or 3 and a reflecting mirror for reflecting light emitted from the mercury lamp.

6. A high pressure mercury lamp comprising:

a luminous bulb enclosing at least mercury as a luminous material and a pair of electrodes opposed to each other; and a pair of sealing portions for sealing a pair of metal foils electrically connected to the pair of electrodes, respectively;

wherein an electrode central axis of one of the pair of electrodes is dislocated from an electrode central axis of the other electrode, and a shortest distance d (cm) between a head of one of the electrodes and a head of the other electrode is larger than a value of $(6M/13.6\pi)^{1/3}$ when a total mass of the enclosed mercury is M (g).

7. The high pressure mercury lamp of claim 1, 2, 3 or 6, wherein a distance D between the pair of electrodes of the high pressure mercury lamp is 2 mm or less, and a total mass of the enclosed mercury is 150 $mg/cm^3$ or more.

* * * * *